US009810507B2

(12) United States Patent
Hendricks et al.

(10) Patent No.: US 9,810,507 B2
(45) **Date of Patent: *Nov. 7, 2017**

(54) OPEN IGNITION BREECH PLUG AND CONVERSION SYSTEM AND METHOD FOR MUZZLE-LOADING FIREARM

(71) Applicant: BLACKPOWDER PRODUCTS, INC., Lawrenceville, GA (US)

(72) Inventors: Mark D. Hendricks, Duluth, GA (US); Kenneth L. Morgan, Lawrenceville, GA (US)

(73) Assignee: BLACKPOWDER PRODUCTS, INC., Lawrenceville, GA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/273,199

(22) Filed: Sep. 22, 2016

(65) Prior Publication Data

US 2017/0082392 A1 Mar. 23, 2017

Related U.S. Application Data

(63) Continuation of application No. 14/318,974, filed on Jun. 30, 2014, now Pat. No. 9,459,071.

(Continued)

(51) Int. Cl.
*F41C 7/00* (2006.01)
*F41C 9/08* (2006.01)

(Continued)

(52) U.S. Cl.
CPC ..... *F41C 9/08* (2013.01); *F41A 3/04* (2013.01); *F41A 3/58* (2013.01); *F41A 3/64* (2013.01);

(Continued)

(58) Field of Classification Search
CPC ..... F41C 9/08; F41C 9/085
See application file for complete search history.

(56) References Cited

U.S. PATENT DOCUMENTS

D173,476 S 2/1876 Ladd
3,780,464 A 12/1973 Anderson (Continued)

FOREIGN PATENT DOCUMENTS

EP 0178284 A1 4/1986

OTHER PUBLICATIONS

Blackpowder Products, Inc., Quick-Release Breechplug (QRBP) (2010).

(Continued)

*Primary Examiner* — Gabriel Klein
(74) *Attorney, Agent, or Firm* — Gardner Groff Greenwald & Villanueva, PC

(57) ABSTRACT

An open ignition breech plug for a muzzle-loading firearm. The open ignition breech plug includes an internal body portion for removable installation into the breech end of a barrel of the muzzle-loader, and an external body portion comprising a gripping surface, a nipple for receiving an ignition source such as a percussion cap, and at least one open portion of the external body portion for external visibility of the nipple and a percussion cap mounted thereon. The nipple can be integrally formed with the external body portion or removably mounted thereto.

24 Claims, 7 Drawing Sheets

Related U.S. Application Data

(60) Provisional application No. 61/846,208, filed on Jul. 15, 2013.

(51) Int. Cl.

| | |
|---|---|
| ***F41A 11/00*** | (2006.01) |
| ***F42B 5/02*** | (2006.01) |
| ***F41A 3/04*** | (2006.01) |
| ***F41A 21/12*** | (2006.01) |
| ***F41A 3/58*** | (2006.01) |
| ***F41A 3/64*** | (2006.01) |

(52) U.S. Cl.

CPC ..... *F41A 11/00* (2013.01); *F41A 21/12* (2013.01); *F42B 5/025* (2013.01); *Y10T 29/49716* (2015.01)

(56) References Cited

U.S. PATENT DOCUMENTS

| | | | | |
|---|---|---|---|---|
| 4,222,191 | A | 9/1980 | Lee et al. | |
| 4,232,468 | A | 11/1980 | Chapin | |
| 5,133,143 | A | 7/1992 | Knight | |
| 5,307,583 | A | 5/1994 | Mahn et al. | |
| 5,639,981 | A | 6/1997 | French | |
| 5,644,861 | A | 7/1997 | Knight | |
| 5,706,598 | A | 1/1998 | Johnston | |
| 5,782,030 | A | 7/1998 | French | |
| 5,860,240 | A | 1/1999 | Ball et al. | |
| 5,907,920 | A | 6/1999 | Laney | |
| 5,915,934 | A | 6/1999 | Knight et al. | |
| 5,941,004 | A | 8/1999 | Pedersoli | |
| 6,216,380 | B1 | 4/2001 | McGarity, Jr. et al. | |
| 6,219,951 | B1 * | 4/2001 | Cate | F41C 9/08 42/51 |
| 6,311,421 | B1 | 11/2001 | Knight | |
| 6,343,430 | B1 * | 2/2002 | Martel | F41C 9/08 42/51 |
| 6,604,311 | B1 | 8/2003 | Laney et al. | |
| 6,718,677 | B2 | 4/2004 | Camp | |
| 6,996,930 | B2 | 2/2006 | Hengstenberg et al. | |
| 7,073,283 | B2 | 7/2006 | Watley | |
| 7,140,138 | B1 | 11/2006 | Laney et al. | |
| 7,260,911 | B2 | 8/2007 | Davis | |
| 7,353,631 | B2 | 4/2008 | Calvete Zumalde | |
| 7,526,888 | B1 | 5/2009 | Joyce | |
| 7,621,064 | B2 | 11/2009 | Laney et al. | |
| 7,726,058 | B2 | 6/2010 | Richards | |
| 7,814,694 | B2 | 10/2010 | Laney et al. | |
| 7,908,781 | B2 | 3/2011 | Laney et al. | |
| 7,954,269 | B2 | 6/2011 | Laney et al. | |
| 8,261,478 | B2 | 9/2012 | Laney et al. | |
| 8,312,657 | B2 | 11/2012 | Lizarralde Ibarguren | |
| 9,459,071 | B2 | 10/2016 | Hendricks et al. | |
| 2002/0035800 | A1 | 3/2002 | Lewis | |
| 2006/0086029 | A1 | 4/2006 | Kirkpatrick | |
| 2007/0039222 | A1 | 2/2007 | Lizarralde et al. | |
| 2009/0265973 | A1 | 10/2009 | Calvete Zumalde | |

OTHER PUBLICATIONS

Thompson Center Northwest Explorer Muzzleloading Rifle 50 Caliber Synthetic Stock Black 28"Blue Barrel; date unknown; 2 pgs.

Traditions Performance Firearms Vortek Ultralight Northwest Magnum .50 Cal Synthetic Blk R461120WM; date unknown; 3 pgs.

* cited by examiner

OPEN IGNITION BREECH PLUG AND CONVERSION SYSTEM AND METHOD FOR MUZZLE-LOADING FIREARM

CROSS-REFERENCE TO RELATED APPLICATIONS

This application is a continuation of U.S. Non-Provisional patent application Ser. No. 14/318,974 filed Jun. 30, 2014, which claims the benefit of U.S. Provisional patent application Ser. No. 61/846,208 filed Jul. 15, 2013, the entireties of which are hereby incorporated herein by reference for all purposes.

TECHNICAL FIELD

The present invention relates generally to the field of muzzle-loading firearms, and more particularly to an open-ignition regulation compliant breech plug for use with muzzle-loading firearms, and to systems and methods for conversion or retrofitting of a muzzle-loading firearm with an open-ignition firing system.

BACKGROUND

Many muzzle-loading firearms incorporate a removable breech plug that is installed into the breech end of the barrel. Muzzle-loader breech plugs commonly have a nipple that accepts a primer, such as a 209 shotshell primer, for initiating the primary powder charge (typically black powder, Pyrodex or other propellant). Known breech plugs are typically configured to conceal or cover the primer from the elements, to help reduce undesirable malfunctions of the primer initiating firing of the firearm.

Game regulations or hunting laws in some states require use of a percussion cap rather than a shotshell primer, and/or require that the percussion cap or other primer must be at least partially visible from the exterior of the firearm and thereby more exposed to the elements, to more closely replicate more primitive hunting conditions faced by hunters prior to the advent of modern firearms (compliance with such regulations is commonly referred to as a muzzle-loading firearm being "Northwest legal" or "open-ignition compliant"). These laws may be seen as a drawback to many hunters and outdoorsmen who have muzzle-loading firearms that incorporate a modern concealed primer breech plug design, as they might be required to purchase an entirely new muzzle-loader that is Northwest legal to hunt in those states having such regulations.

Accordingly, it can be seen that needs exist for improvements to muzzle-loading firearms and to muzzle-loader breech plugs allowing for Northwest legal or open-ignition compliance, and/or for allowing retrofit conversion of a muzzle-loading firearm originally having a concealed primer breech plug to be Northwest legal or open-ignition compliant. It is to the provision of improvements to muzzle-loading firearms, and to ignition systems and breech plugs for such firearms, meeting these and other needs that the present invention is primarily directed.

SUMMARY

In example embodiments, the present invention provides an open ignition breech plug for retrofit conversion of a muzzle-loading rifle or other muzzle-loading firearm having a removable concealed primer breech plug, to render the firearm Northwest legal or open-ignition compliant.

In one aspect, the present invention relates to a breech plug for a muzzle-loading firearm including a cylindrical body extending from a first end to a second end along a longitudinal axis. The cylindrical body preferably includes an internal body portion having a connection area proximal the second end for removable installation into a cooperating connection area of the breech end of a barrel of the muzzle-loading firearm. The body preferably also includes an external body portion proximal the first end and including a gripping surface having a recessed portion defined therein, a nipple positioned within the recessed portion for receiving an ignition source, and at least one opening provided on the gripping surface and in communication with the recessed portion to allow for external visibility of the nipple through the gripping surface.

In another aspect, the present invention relates to a breech plug for a muzzle-loading firearm including a body extending from a first end to a second end along a longitudinal axis. The body preferably includes an internal body portion and an external body portion. The internal body portion is proximal the second end for removable installation into the breech end of a barrel of the muzzle-loading firearm. The external body portion is proximal the first end and includes a gripping surface and at least one opening. The gripping surface preferably includes a recessed portion defined therein for receiving an ignition source and the at least one opening preferably extends from an outer portion of the gripping surface to the recessed portion for external visibility of the ignition source.

In still another aspect, the invention relates to a conversion kit for converting a non-Northwest legal muzzle-loader into a Northwest legal muzzle-loader. The kit preferably includes a breech plug comprising an internal body portion for removable installation into the breech end of a barrel of the muzzle-loader, and an external body portion comprising a gripping surface having a recessed portion defined therein, a nipple positioned within the recessed portion for receiving an ignition source, and at least one opening provided on the gripping surface and in communication with the recessed portion for external visibility of the nipple. The kit optionally further includes a firing pin, a firing pin spring, and/or a firing pin bushing, compatible with the muzzle-loader and the breech plug when installed in the muzzle-loader.

In another aspect, the invention relates to a method of converting a non-Northwest legal muzzle-loader into a Northwest legal muzzle-loader. The method preferably includes replacement of a standard breech plug of the muzzle-loader with a conversion breech plug comprising an internal body portion for removable installation into the breech end of a barrel of the muzzle-loader, and an external body portion comprising a gripping surface having a recessed portion defined therein, a nipple positioned within the recessed portion for receiving an ignition source, and at least one opening provided on the gripping surface and in communication with the recessed portion for external visibility of the nipple. The method preferably includes removal of the standard breech plug from the barrel of the muzzle-loader, installation of the conversion breech plug into the barrel of the muzzle-loader, and optionally conversion of one or more of includes a firing pin, a firing pin spring, and/or a firing pin bushing of the muzzle-loader for compatibility with the installed conversion breech plug.

In still another aspect, the invention relates to a muzzle-loading firearm including a barrel and a breech plug. The barrel preferably includes a breech end and a muzzle end. The breech plug preferably includes an internal body portion and an external body portion. The internal body portion is preferably configured for removable installation into the breech end of the barrel. The external body portion preferably includes a gripping surface and at least one opening. The gripping surface preferably has a recessed portion defined therein for receiving an ignition source. The at least one opening preferably extends from an outer portion of the gripping surface to the recessed portion to allow for external visibility of the ignition source.

These and other aspects, features and advantages of the invention will be understood with reference to the drawing figures and detailed description herein, and will be realized by means of the various elements and combinations particularly pointed out in the appended claims. It is to be understood that both the foregoing general description and the following brief description of the drawings and detailed description of the invention are exemplary and explanatory of preferred embodiments of the invention, and are not restrictive of the invention, as claimed.

DETAILED DESCRIPTION OF EXAMPLE EMBODIMENTS

The present invention may be understood more readily by reference to the following detailed description of the invention taken in connection with the accompanying drawing figures, which form a part of this disclosure. It is to be understood that this invention is not limited to the specific devices, methods, conditions or parameters described and/or shown herein, and that the terminology used herein is for the purpose of describing particular embodiments by way of example only and is not intended to be limiting of the claimed invention. Any and all patents and other publications identified in this specification are incorporated by reference as though fully set forth herein.

Also, as used in the specification including the appended claims, the singular forms "a," "an," and "the" include the plural, and reference to a particular numerical value includes at least that particular value, unless the context clearly dictates otherwise. Ranges may be expressed herein as from "about" or "approximately" one particular value and/or to "about" or "approximately" another particular value. When such a range is expressed, another embodiment includes from the one particular value and/or to the other particular value. Similarly, when values are expressed as approximations, by use of the antecedent "about," it will be understood that the particular value forms another embodiment.

Figure 1A:
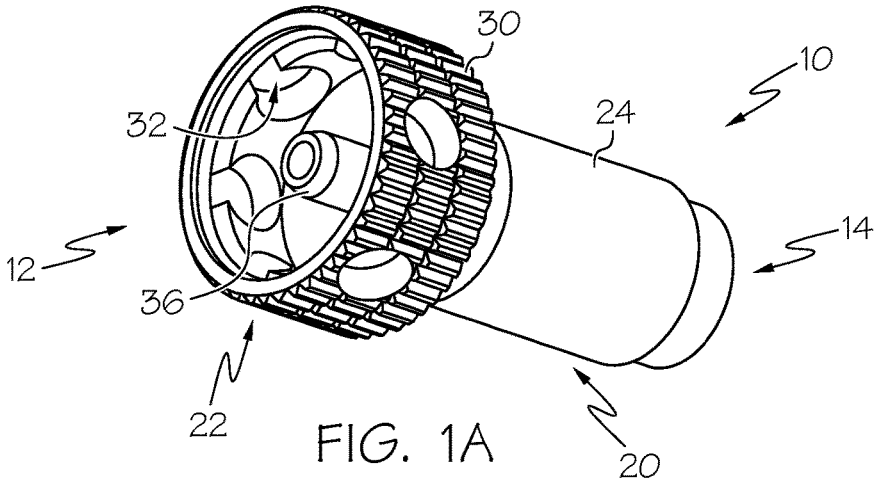
FIG. 1A is a perspective view of an open ignition conversion breech plug according to an example embodiment of the present invention.
Figure 1B:
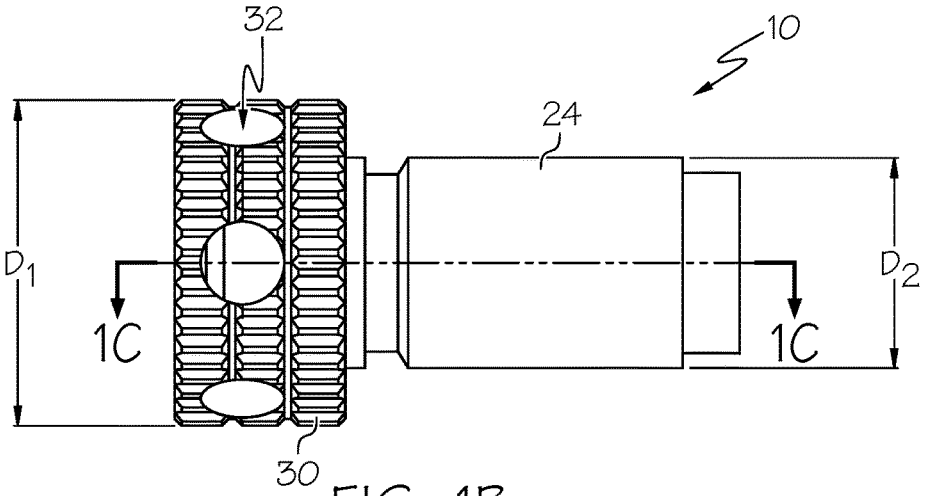
FIG. 1B is a side view of the open ignition breech plug of FIG. 1A.
Figure 1C:
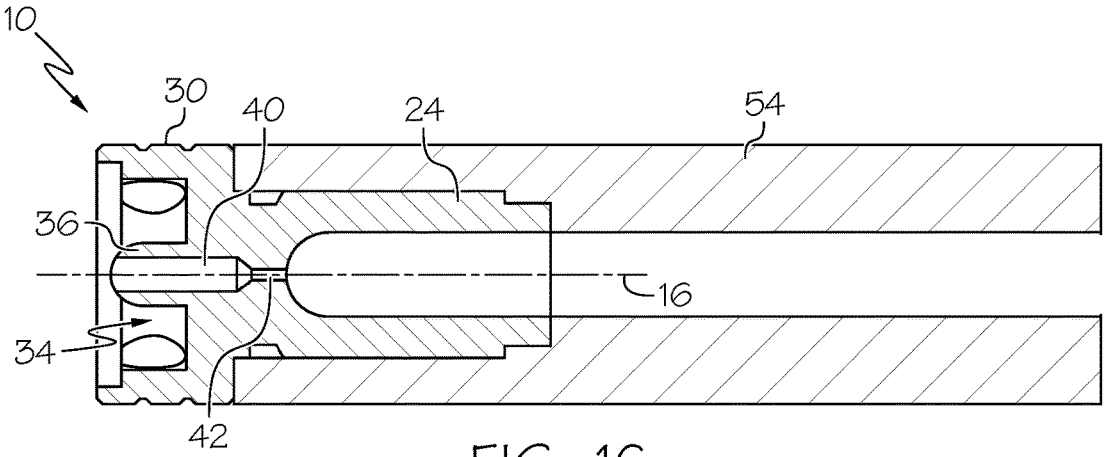
FIG. 1C is a cross sectional view of the open ignition breech plug of FIG. 1B taken along line 1C-1C, and shown installed in the barrel of a muzzle-loading firearm.

With reference now to the drawing figures, wherein like reference numbers represent corresponding parts throughout the several views, FIGS. 1A-C show an open ignition breech plug 10 according to an example embodiment of the present invention. The open ignition breech plug 10 generally comprises a cylindrical body having a T-shaped cross-sectional profile, extending from a first or proximal end 12 to a second or distal end 14 along a longitudinal axis 16. An internal cylindrical body or sleeve portion 20 is defined at the second end 14 and a coaxial external cylindrical body or grip portion 22 is defined at the first end 12. The internal body portion 20 comprises a threaded connection area 24 and the external body portion 22 comprises an expanded gripping flange or collar 30 having a plurality of bores or openings 32 formed therein. Preferably, the openings 32 allow external visibility of a primer receiver or nipple 36 (and percussion cap 37, as will be described below) when mounted to a muzzle-loading firearm 50. The threaded connection area 24 is preferably configured for removably mounting into engagement with a cooperatively threaded chamber at the breech end portion 56 of a barrel 54 of the firearm 50 (see FIG. 3). The expanded gripping flange 30 is provided for allowing the operator to grip the open ignition breech plug with ease when movably mounting the plug 10 to the breech end 56 of the barrel 54. Preferably, the gripping flange 30 comprises one or more knurled projections, ribs, grooves, ridges or other irregular or undulating external surface gripping elements for easily gripping with a user's hand or fingers to install and remove the breech plug into the barrel. Preferably, the breech plug is finger-removable by manual application of force by a user without the need for tools. In alternate forms, the breech plug may be tool-removable, for example having flats or other means for engagement by a wrench or other hand tool. The expanded gripping surface 30 preferably has an external diameter D1 that is substantially greater than the outside thread diameter D2 of the threaded connection area 24, and diameter D1 preferably generally matches the outside diameter of the barrel 54 at its breech end. The outside thread diameter D2 of the threaded connection area 24 preferably corresponds to the inside diameter of the breech plug chamber at the breech end of the barrel 54.

As depicted in FIG. 1C, the plug 10 is removably installed into the breech end 56 of the barrel 54 of the muzzle-loading firearm 50. The expanded gripping surface 30 preferably comprises a recess or cutout portion 34 wherein the primer holder or nipple 36 projects outwardly from a base panel or partition of the recess 34 and extends proximally along the longitudinal axis 16. Thus, with the recessed portion 34 defined within the expanded gripping surface 30, the expanded gripping surface 30 generally forms a peripheral flange around the recess 34 preferably surrounding the nipple or receiver 36. In example forms, the recess 34 is generally cylindrical in shape, but in other forms, the recess 34 may be otherwise shaped and sized as desired. In example embodiments, the receiver or nipple 36 can be integral with the plug 10 or fixedly/removably mounted thereto (see FIGS. 5A-C), and preferably can be sized, shaped and/or formed to accept a standard percussion cap 37 (see FIGS. 3-4), which functions as the firearm's ignition system or ignition means. Alternatively, the nipple or receiver can be configured to receive a .209 shotgun primer, or other ignition means for sending a charge to ignite gunpowder to discharge the firearm 50. From the end of the nipple 36, an internal conduit 40 extends towards the second end 14 and communicates with a flash aperture 42 extending to the second end 14 of the breech plug and into communication with the barrel chamber where the main powder charge is deposited. Thus, when the ignition means ignites to create the ignition charge, the ignition charge moves through the internal conduit 40 and through the flash aperture 42, and to the second end 14 of the plug 10 into the barrel, wherein the primary gunpowder charge is ignited and explodes to discharge the firearm 50 and propel a bullet out of the barrel and along its trajectory.

One or more openings 32 are formed through the peripheral flange of the expanded gripping surface 30. The openings 32 preferably are generally circular or cylindrical in shape. Preferably a plurality of openings 32 are spaced circumferentially about the periphery of the expanded gripping surface 30. In one form, the expanded gripping surface 30 comprises one opening. In other forms, the expanded gripping surface 30 comprises two or more openings, for example six openings 32 as depicted in FIGS. 1A-C. Preferably, the one or more openings 32 provide sufficient visibility of the nipple 36 and/or ignition means 37 (when mounted thereto) from one or more viewpoints external of the firearm, viewed from substantially any angle, both when the breech 56 is in a closed position (see FIG. 3) and when the breech is in an open position (see FIG. 4). In this manner, the one or more openings preferably allow the nipple 36 and ignition means 37 to be sufficiently exposed to the environment surrounding the plug 10 to comply with Northwest legal or open-ignition compliant regulations. Thus, when the plug 10 is removably installed into the breech end 56 of the barrel 54 of the firearm 80, the firearm 80 is equipped with an ignition system in which any portion of the cap 37 (e.g., ignition means) is exposed or visible when the weapon is cocked and ready to fire. In example forms, the openings are generally oriented to extend substantially perpendicular (or about 90 degrees) relative to the longitudinal axis 16. Optionally, in other example forms, the openings can be oriented to extend at an oblique angle relative to the longitudinal axis (see FIGS. 7-7A), for example obliquely angled in the proximal or distal directions. Optionally, the openings may take on shapes including but not limited to oval, elliptical, box-like, polygonal, irregular, etc., which can comprise a plurality of surface configurations including but not limited to wavy, zig-zag, lobed, arcuate, undulating, jagged, smooth, etc. In example embodiments, the ratio of the removed surface area (e.g., openings) to the entire surface area of the gripping flange 30 (openings/surface area) is preferably between about 3%-80%, more preferably between about 6%-60%, and more preferably between about 9%-40%. In one example form, as depicted in FIGS. 1A-C, the circumference of the gripping flange is about 3.14" (diameter being about 1" and the height being about 0.5") and the diameter of each of the six openings 30 is about 0.24". Thus, the openings 30 reduce the surface area of the gripping surface 30 by about 17% (surface area=2 $\pi rh$, surface area without openings is about 1.57 $in^2$, surface area with openings is about 1.30 $in^2$, surface area of gripping surface with six 0.24" diameter openings is about 83% $((1.30\ in^2/1.57\ in^2)\times 100)$). In another example form, five 0.24" openings are provided along the surface of the gripping flange 30, which reduces the surface area of the gripping surface by about 15%. In yet another example embodiment, the gripping flange 30 comprises four 0.24" diameter openings and reduces the surface area of the gripping surface by about 11%. According to another example, the gripping flange comprises six 0.10" diameter openings and reduces the surface area by about 3%. According to yet another example form, the gripping flange comprises six 0.45" diameter openings and reduces the surface area by about 62%. Optionally, other openings of any shape or size may be provided (with or without the openings as described above) to reduce the surface area of the gripping surface as desired, for example to ensure that any portion of the cap is exposed or visible when the weapon is cocked and ready to fire and thereby complying with the Northwest legal or open-ignition compliant regulations.

Figure 2:
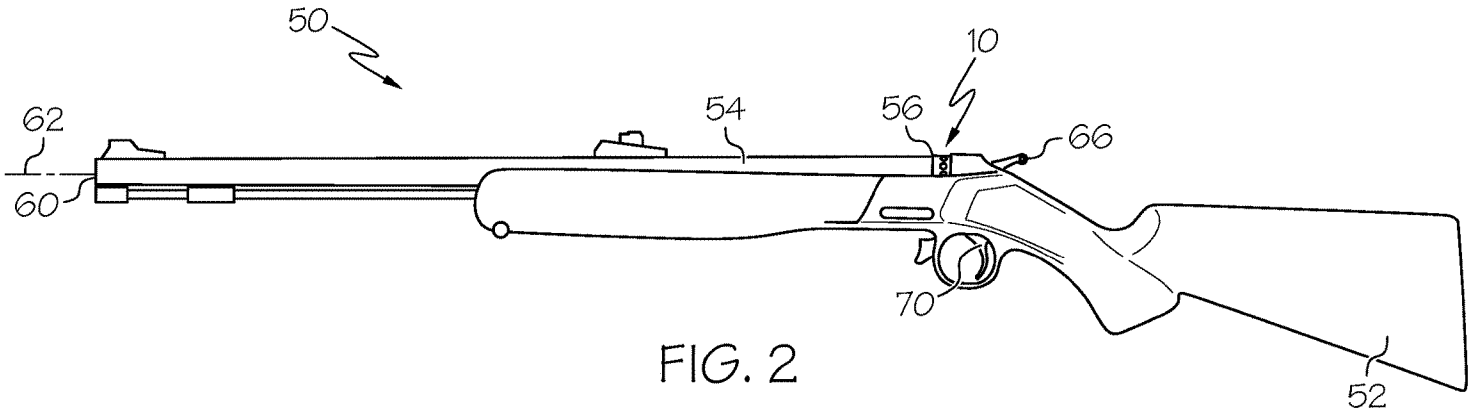
FIG. 2 is a side view of a muzzle-loading rifle for use with the open ignition breech plug adapter of FIGS. 1A-C, according to an example embodiment of the present invention.
Figure 3:
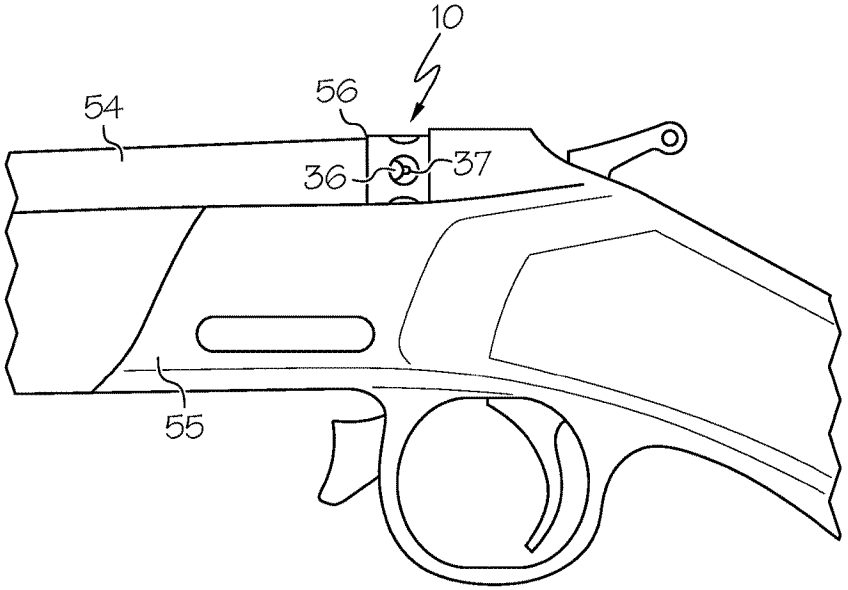
FIG. 3 is an enlarged view of a portion of the muzzle-loading rifle of FIG. 2, with the action closed, and showing the open ignition breech plug in greater detail wherein a nipple and ignition means are externally visible through a portion of the conversion breech plug.
Figure 4:
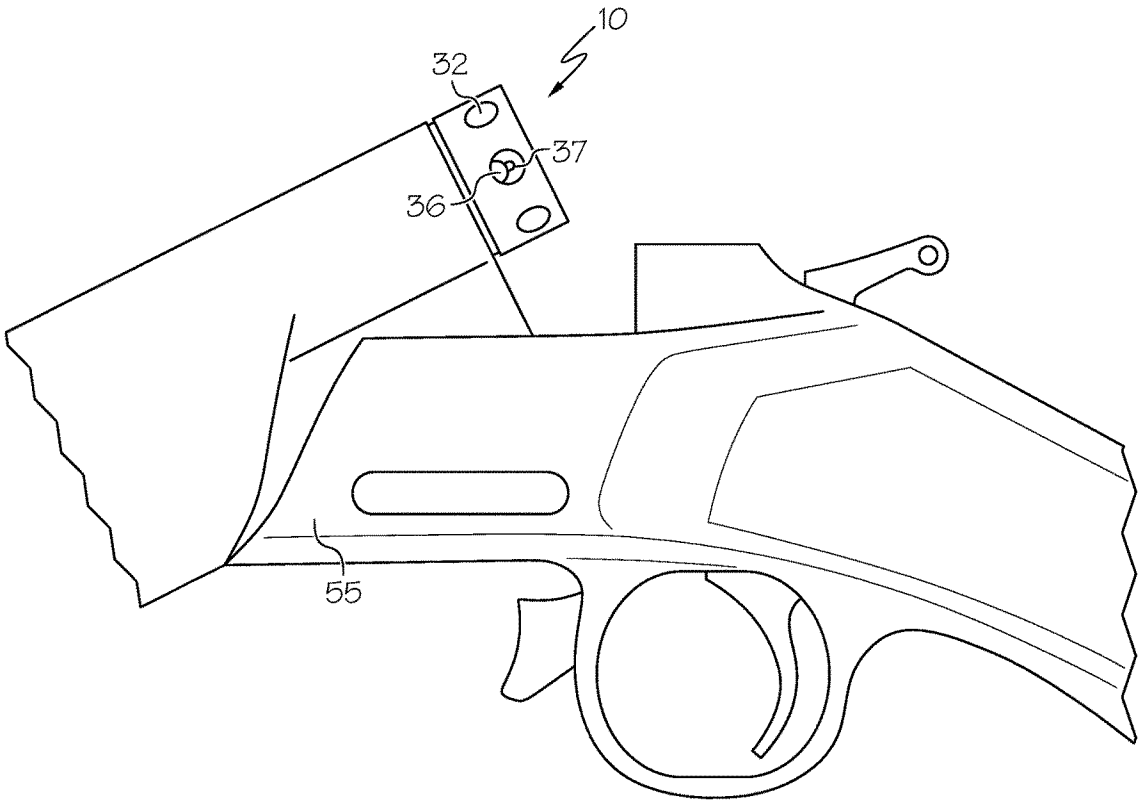
FIG. 4 is an enlarged view of a portion of the muzzle-loading rifle of FIG. 2, showing the action open, wherein the open ignition breech plug is removably engaged therewith, and wherein the nipple and ignition means are externally visible.

FIGS. 2-4 show further details of the muzzle-loading firearm 50. In the depicted embodiment the firearm 50 is a break action muzzle-loading rifle, but the breech plug of the present invention may also be adapted for use in connection with other muzzle-loading firearm formats incorporating a removable breech plug. The firearm generally includes a stock 52, a barrel 54, a hammer 66, a trigger 70, a firing pin, a firing pin spring, a firing pin bushing, and the open ignition breech plug 10. The barrel 54 of the depicted embodiment is pivotally mounted to a frame 55 and extends along a longitudinal axis 62 from the breech end 56 to a muzzle end 60. As depicted in FIG. 3, the breech end 56 of the barrel 54 is in the closed position and the nipple 36 and ignition means 37 is visible by an observer through the openings 32 from one or more external vantage points. Similarly, as depicted in FIG. 4, the breech end 56 of the barrel 54 is in the open position and the nipple 36 and ignition means 37 are visible through the openings 32. As seen best with reference to FIG. 3, the peripheral flange of the expanded gripping surface 30 of the breech plug 10 preferably has a longitudinal dimension transverse to its diameter D1, which is approximately equal to or slightly less than the spacing distance between the breech end 56 of the barrel 54 and the confronting firing pin housing area of the frame 55 adjacent the hammer 66. In this manner, when the action is closed the nipple 36 and ignition means are enclosed and shielded on all sides and on the proximal and distal ends within the recess 34, but remain visible from an external vantage point through the openings 32.

Figure 5A:
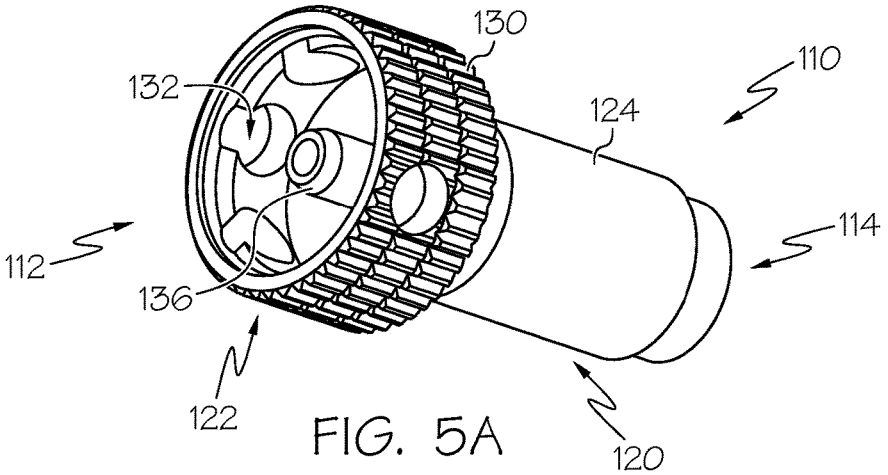
FIG. 5A is a perspective view of an open ignition conversion breech plug according to another example embodiment of the present invention.
Figure 5B:
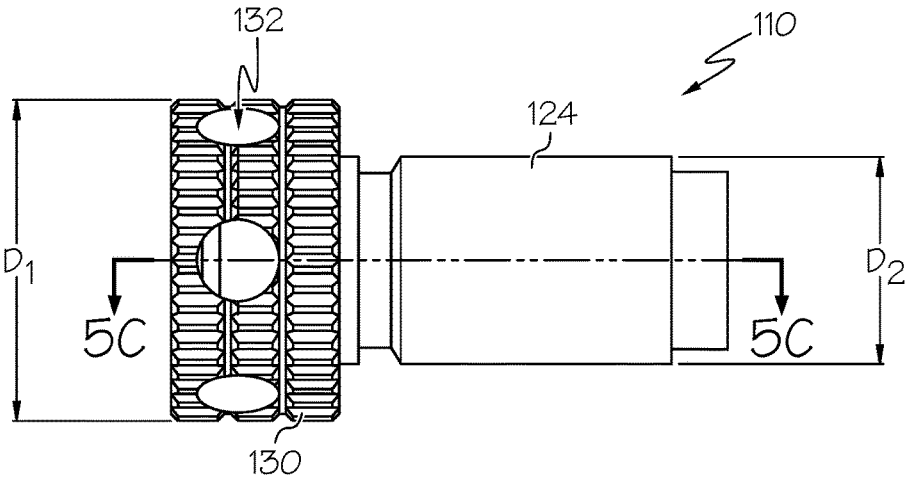
FIG. 5B is a side view of the open ignition breech plug of FIG. 5A.
Figure 5C:
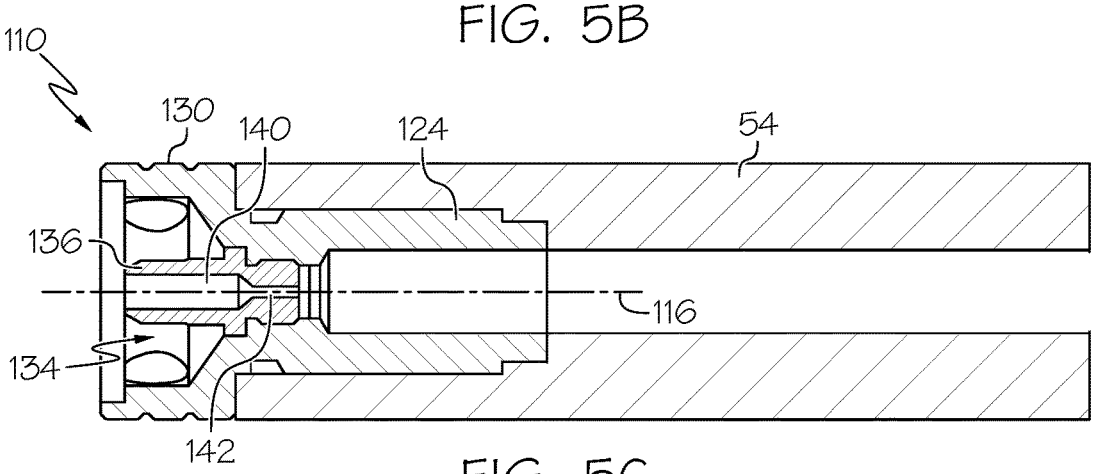
FIG. 5C is a cross sectional view of the open ignition breech plug of FIG. 5B taken along line 5C-5C, and shown installed in the barrel of a muzzle-loading firearm.

FIGS. 5A-C show an open ignition breech plug 110 according to another example embodiment of the present invention. As depicted, the plug 110 is substantially similar to the plug 10 as shown and described above, and includes an interchangeable or removably mountable nipple 136. In this manner, different nipple formats, for example compatible with a percussion cap (#11 cap), a .209 primer, a musket cap, or other ignition means, can be interchangeably attached to the breech plug, for example by threaded attachment, press-fit, snap-connection or other attachment means. The cutout portion or recess 134 further comprises a conical recess portion formed therein and the nipple 136 is removably engaged generally centrally at the apex of the conical recess.

Figure 6:
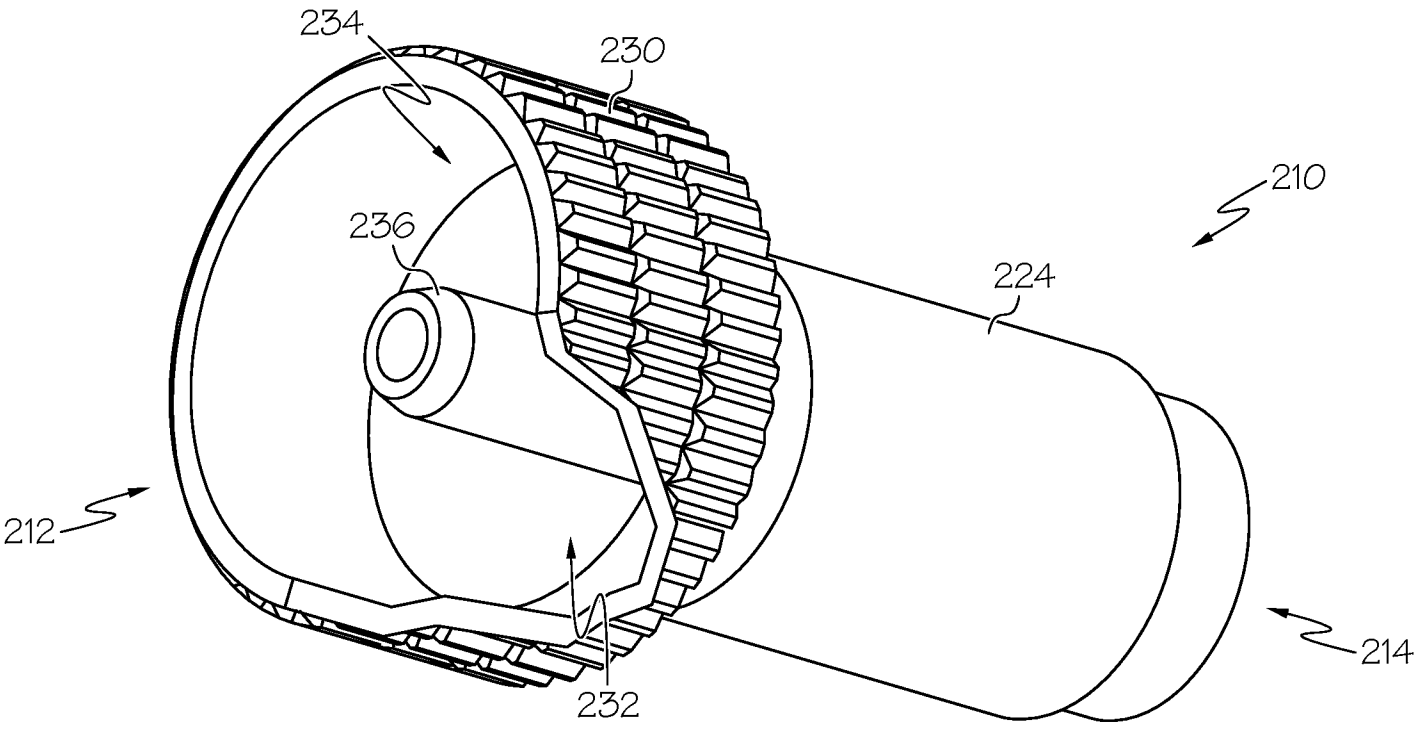
FIG. 6 is a perspective view of an open ignition breech plug according to another example embodiment of the invention.

In additional alternative embodiments, the open ignition breech plug can have a cutout or removed portion formed along a portion of the peripheral flange of the expanded gripping surface, or other forms of openings for exposure and external visibility of the ignition means. For example, as depicted in FIG. 6, an open ignition breech plug 210 comprises a cutout section 232 formed in the peripheral flange of the expanded gripping surface 230. In one form, the cutout 232 is formed to extend to the first end 212 of the plug 210, for example wherein a portion of the expanded gripping surface proximal the first end 212 is entirely removed. In example forms, the cutout 232 is at least about 15-20% of the peripheral flange, more preferably about 20-25%, and more preferably about 30-35%. Preferably, the cutout 232 is formed on the peripheral flange such that the external body portion can still be gripped for installation/removal of the breech plug 210 to/from the breech end of the barrel. Furthermore, as described above, the cutout 232 is preferably configured such that when the plug 210 is removably installed into the breech end of the barrel, the firearm is equipped with an ignition system in which any portion of the cap is exposed or visible when the weapon is cocked and ready to fire. Optionally, the cutout 232 can be positioned, shaped, sized and oriented as desired. In further alternative embodiments the expanded gripping surface 230 can comprise two or more cutouts 232, which may cause the cutouts 232 to be at least about 40-55% of the peripheral flange. Additionally, the expanded gripping surface 230 may have a combination of one or more cutouts 232 and one or more openings 32, 132 (as depicted in FIGS. 1-5).

Figure 7:
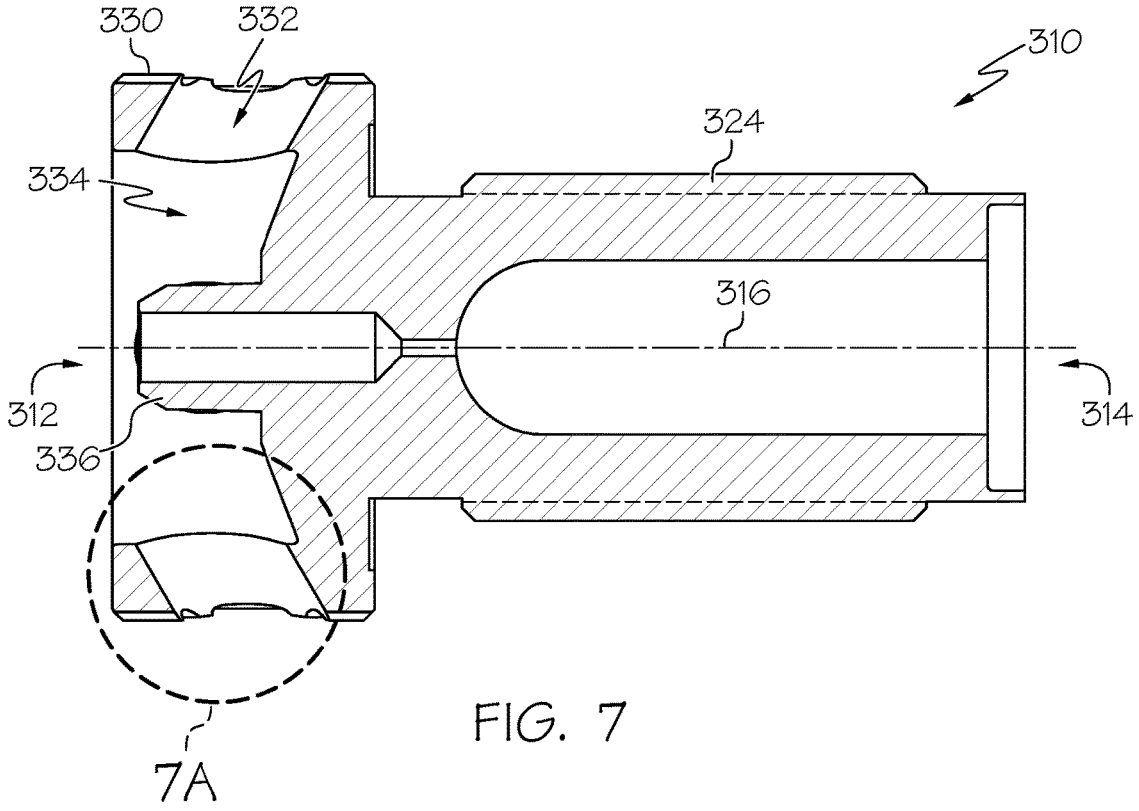
FIG. 7 is a cross sectional view of an open ignition breech plug according to yet another example embodiment of the present invention.
Figure 7A:
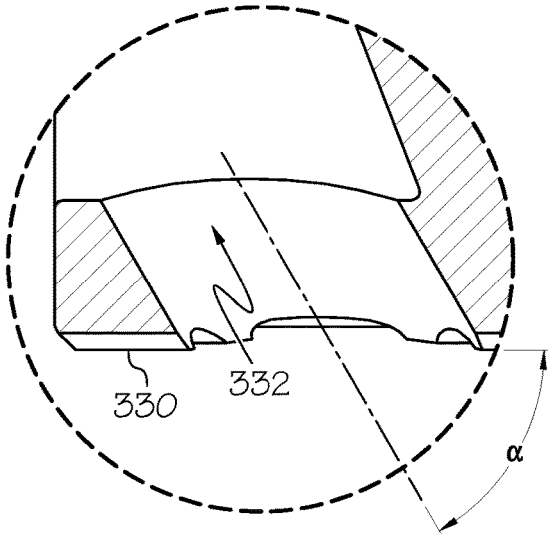
FIG. 7A is a detailed view of a portion of the open ignition breech plug of FIG. 7, showing the orientation of the openings formed in the gripping surface.

In another alternative embodiment, the openings are oriented to extend at an oblique angle relative to the longitudinal axis. For example, as depicted in FIGS. 7-7A, an open ignition breech plug 310 comprises openings 332 that are oriented to extend at an oblique angle $\alpha$ relative to the longitudinal axis 316 (or gripping surface 330 that is laterally offset therefrom). In example forms, the angle $\alpha$ can be an acute angle (angled toward the distal end 314 of the breech plug) or an obtuse angle (angled toward the proximal end 312 of the breech plug) relative to the longitudinal axis 316 (or laterally offset gripping surface 330). In one form, the angle $\alpha$ is about 60 degrees. Alternatively, the angle $\alpha$ can vary, for example, between about 30-150 degrees, between about 45-135 degrees, or between about 60-120 degrees. Optionally, the angle $\alpha$ of the openings can be oriented as desired.

Figure 8A:
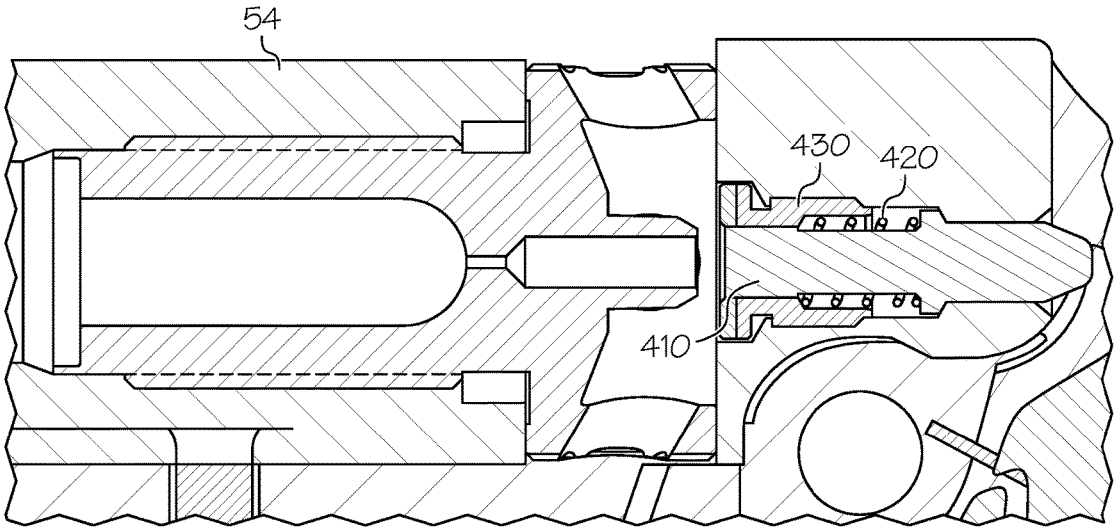
FIG. 8A is a cross sectional view of the open ignition breech plug of FIG. 7 shown installed in the barrel of a muzzle-loading firearm, and showing conversion components of a conversion kit to be interchanged with corresponding original components of the firearm to convert the firearm to be operable with an open ignition breech plug, according to an example form of the invention.
Figure 8B:
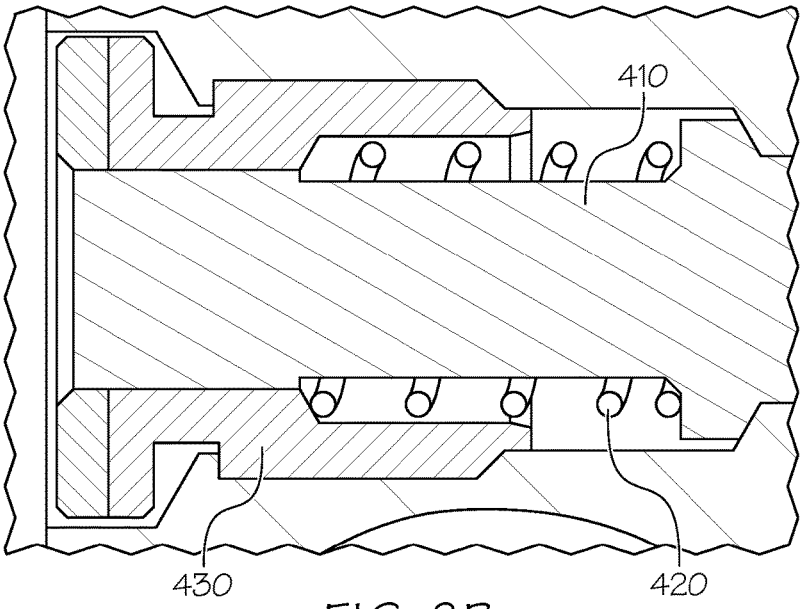
FIG. 8B is a detailed view of components of the conversion kit shown in FIG. 8A.

The present invention comprehends the above described open ignition breech plug 10, 110, 210, 310, as well as a muzzle-loading firearm including such a breech plug, either as original equipment, or alternatively as a retrofit component for conversion of a non-Northwest legal muzzle-loader into a Northwest legal muzzle-loader. The present invention also comprehends a method of conversion of a non-Northwest legal muzzle-loader into a Northwest legal muzzle-loader by removal of the original standard breech plug and installation of an open ignition conversion breech plug as described herein into the breech end of the firearm barrel. In further embodiments of the invention, the open ignition breech plug 10, 110, 210, 310 can be one component of a conversion kit, optionally in combination with one or more additional components to convert a muzzle-loading firearm to be operable with the open ignition breech plug. For example, in one form as depicted in FIGS. 8A-B, a firing pin 410, a firing pin spring 420, and a firing pin bushing 430 are interchanged with the original firing pin, firing pin spring, and firing pin bushing of the firearm, and along with interchanging the open ignition breech plug with the original breech plug, a non-Northwest legal muzzle-loader is converted into a Northwest legal muzzle-loader.

While the invention has been described with reference to preferred and example embodiments, it will be understood by those skilled in the art that a variety of modifications, additions and deletions are within the scope of the invention, as defined by the following claims.

What is claimed is:

1. A breech plug for a break-action muzzle-loading firearm, the breech plug comprising;

an internal body portion comprising a connection area for removable installation within a breech end of a barrel of the muzzle-loading firearm; and an external body portion comprising a gripping flange at least partially surrounding a recess, a nipple positioned within the recess for receiving a percussion cap ignition source, and at least one opening through the gripping flange allowing visibility of the nipple and percussion cap ignition source through said at least one opening when the firearm is cocked and ready to fire.

2. The breech plug of claim 1, wherein an internal conduit extends through the nipple and along a longitudinal axis through the breech plug for communication between the percussion cap ignition source and the breech end of the barrel of the muzzle-loading firearm.

3. The breech plug of claim 1, wherein the nipple is integrally formed with the breech plug.

4. The breech plug of claim 1, wherein the at least one opening through the gripping flange comprises a circular hole through the gripping flange.

5. The breech plug of claim 1, wherein the at least one opening through the gripping flange comprises a cutout segment of the gripping flange.

6. The breech plug of claim 1, wherein the gripping flange defines an entire gripping flange surface area, and wherein a ratio of the removed surface area formed by the at least one opening compared to the entire gripping flange surface area is between about 3% -80%.

7. The breech plug of claim 6, wherein the ratio is between about 6% -60%.

8. The breech plug of claim 6, wherein the ratio is between about 9% -40%.

9. The breech plug of claim 6, wherein the ratio is between about 11% -17%.

10. The breech plug of claim 6, wherein the ratio is about 15%.

11. The breech plug of claim 1, wherein the at least one opening through the gripping flange is configured such that when the breech plug is removably installed into the breech end of the barrel of the muzzle-loading firearm, the percussion cap ignition source installed on the nipple is exposed to weather and elements external of the breech plug, thereby being open-ignition compliant.

12. A breech plug for a muzzle-loading firearm, the breech plug comprising:

an internal body portion comprising a connection area for removable installation within a breech end of a barrel of the muzzle-loading firearm; and an external body portion comprising a gripping flange at least partially surrounding a recess, a nipple positioned within the recess for receiving a percussion cap ignition source installed thereon, and at least one cutout segment formed along a portion of the gripping flange, wherein the at least one cutout segment is configured such that when the breech plug is removably installed into the breech end of the barrel of the muzzle-loading firearm, the percussion cap ignition source installed on the nipple is exposed to weather and elements external of the breech plug when the firearm is cocked and ready to fire, wherein the body portions are configured such that the external body portion extends from a first end towards a second end and the internal body portion extends from the second end towards the first end, and wherein at least a portion of the at least one cutout segment formed along a portion of the gripping flange extends to the first end.

13. The breech plug of claim 12, wherein an internal conduit extends through the nipple and along a longitudinal axis through the breech plug for communication between the percussion cap ignition source and the breech end of the barrel of the muzzle-loading firearm.

14. The breech plug of claim 12, wherein the nipple is integrally formed with the breech plug.

15. The breech plug of claim 12, wherein the gripping flange defines an entire gripping flange surface area, and wherein a ratio of the removed surface area formed by the at least one cutout segment compared to the entire gripping flange surface area is between about 3% -80%.

16. The breech plug of claim 15, wherein the ratio is between about 6% -60%.

17. The breech plug of claim 15, wherein the ratio is between about 9% -40%.

18. The breech plug of claim 15, wherein the ratio is between about 11% -17%.

19. The breech plug of claim 15, wherein the ratio is about 15%.

20. A breech plug for a break-action muzzle-loading firearm, the breech plug comprising an internal body portion and an external body portion, the internal body portion defining a first diameter and being configured for removable installation into the breech end of a barrel of the muzzle-loading firearm, and the external body portion defining a second diameter and comprising a peripheral flange surrounding a receiver for receiving an ignition source, the second diameter of the external body portion being substantially greater than the first diameter of the internal body portion, the peripheral flange having at least one cutout section allowing external visibility of the receiver when the firearm is cocked and ready to fire, and wherein a ratio of removed surface area formed by the at least one cutout compared to an entire surface area of the peripheral flange is between about 10%-35%.

21. The breech plug of claim 20, wherein when the breech plug is removably installed into the breech end of the barrel of the muzzle-loading firearm, the cutout section exposes the ignition source to weather and elements external of the breech plug when the firearm is cocked and ready to fire.

22. A break-action muzzle-loading firearm comprising:

a barrel comprising a breech end and a muzzle end, the barrel defining a first diameter at the breech end; and a breech plug extending between an external body portion at a first end and an internal body portion at a second end, the internal body portion comprising a second diameter and configured for removable installation into the breech end of the barrel, and the external body portion comprising a third diameter and comprising a collar at least partially surrounding a receiver for an ignition source, the collar defining at least one cutout section exposing the ignition source to weather and elements external of the breech plug when the breech plug is installed in the firearm and the firearm is cocked and ready to fire, wherein the first diameter of the barrel at the breech end is generally similar to the third diameter of the external body portion, and wherein the second diameter of the internal body portion is substantially less than the third diameter of the external body portion.

23. The break-action muzzle-loading firearm of claim 22, wherein the at least one cutout section extends to the first end of the external body portion.

24. The break-action muzzle-loading firearm of claim 22, wherein the ignition source comprises a percussion cap.

* * * * *